US009816781B2

(12) United States Patent
Waichulis

(10) Patent No.: US 9,816,781 B2
(45) Date of Patent: Nov. 14, 2017

(54) GUN/RIFFLE SIGHT FOR TRACKING A MOVING OBJECT

(71) Applicant: Robert Waichulis, Itasca, IL (US)

(72) Inventor: Robert Waichulis, Itasca, IL (US)

(73) Assignee: SHAMROCK INTERNATIONAL FASTENER, LLC, Itasca, IL (US)

( * ) Notice: Subject to any disclaimer, the term of this patent is extended or adjusted under 35 U.S.C. 154(b) by 0 days.

(21) Appl. No.: 15/334,524

(22) Filed: Oct. 26, 2016

(65) Prior Publication Data

US 2017/0122704 A1 May 4, 2017

Related U.S. Application Data

(60) Provisional application No. 62/249,163, filed on Oct. 30, 2015.

(51) Int. Cl.

| | |
|---|---|
| ***F41G 1/00*** | (2006.01) |
| ***F41G 1/473*** | (2006.01) |
| ***F41G 1/033*** | (2006.01) |
| ***F41G 11/00*** | (2006.01) |

(52) U.S. Cl.
CPC ..... *F41G 1/473* (2013.01); *F41G 1/033* (2013.01); *F41G 11/004* (2013.01)

(58) Field of Classification Search
CPC ..... F41G 1/473; F41G 1/033; F41G 11/004
USPC ..... 42/141
See application file for complete search history.

(56) References Cited

U.S. PATENT DOCUMENTS

| | | | | |
|---|---|---|---|---|
| 752,962 | A * | 2/1904 | Eby | F41G 1/473 42/141 |
| 846,173 | A * | 3/1907 | Wise | F41G 1/26 42/139 |
| 1,421,553 | A * | 7/1922 | Pohl | F41G 1/473 42/141 |
| 1,625,060 | A * | 4/1927 | Storm | F41G 1/473 42/141 |
| 2,386,420 | A * | 10/1945 | Bailey | F41G 1/473 42/141 |
| 7,328,531 | B2 * | 2/2008 | Dietz | F41G 1/473 42/133 |
| 9,316,464 | B2 * | 4/2016 | Frederick | F41G 11/004 |
| 2005/0086848 | A1 * | 4/2005 | Dietz | F41G 1/473 42/130 |

* cited by examiner

*Primary Examiner* — Samir Abdosh
(74) *Attorney, Agent, or Firm* — Justin Lampel

(57) ABSTRACT

A gun/rifle sight for tracking a moving object is provided. The gun sight may have a generally elongated frame secured at a distal end of a barrel of a gun in a perpendicular manner with respect to the barrel. In a first embodiment, the gun sight has plurality of pegs which independently and selectively move from a downward orientation to an upward orientation so as to allow a user to gauge the lead time for firing the gun at the moving object. In a second embodiment, a plurality of stationary pegs is secured in a staggered manner around a rotating cylindrical cover. When the cylindrical cover is rotated around the elongated stationary frame, only a single stationary peg may be moved to an upward orientation at a given time.

20 Claims, 12 Drawing Sheets

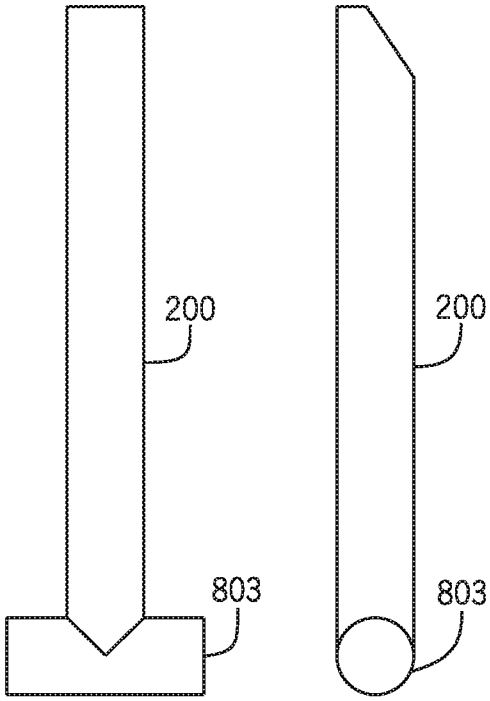
FIG. 2A
FIG. 2B
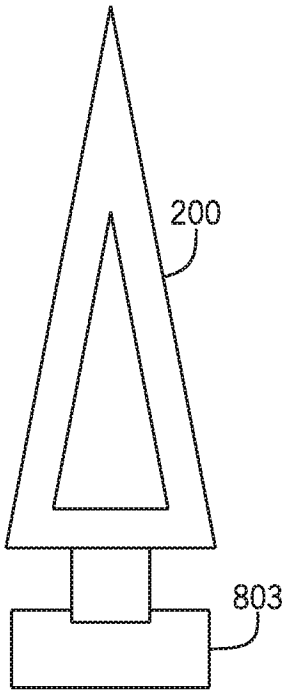
FIG. 3A
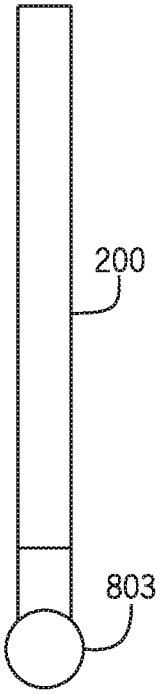
FIG. 3B
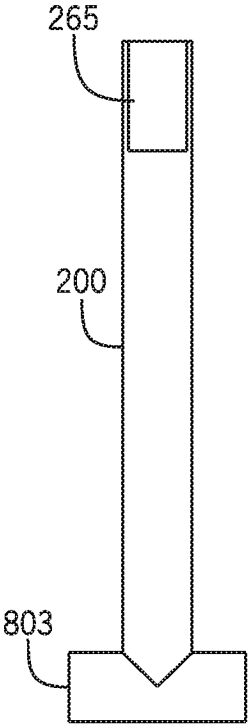
FIG. 4A
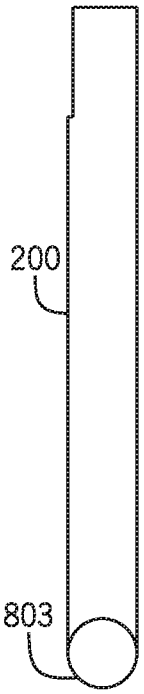
FIG. 4B

GUN/RIFFLE SIGHT FOR TRACKING A MOVING OBJECT

A gun/rifle sight for tracking a moving object is provided. The gun sight may have a generally elongated frame secured at a distal end of a barrel of a gun in a perpendicular manner with respect to the barrel. In a first embodiment, the gun sight has plurality of pegs which independently and selectively move from a downward orientation to an upward orientation so as to allow a user to gauge the lead time for firing the gun at the moving object. In a second embodiment, a plurality of stationary pegs is secured in a staggered manner around a rotating cylindrical cover. When the cylindrical cover is rotated around the elongated stationary frame, only a single stationary peg may be moved to an upward orientation at a given time therein allowing the user to select the lead time for firing the gun at the moving object.

Providing sights for gun for tracking moving targets is known in the prior art. For example, U.S. Pat. No. 8,978,287 to Riley discloses a shotgun sight for mounting to the end of a shotgun barrel having a clear plate having a pin extending generally normally from the plate back toward the eye of the shooter and parallel to the axis of the barrel. The plate has a circle surrounding the base of the pin to facilitate proper eye positioning for use of the plate as a sighting device and a dot marked on the plate between the pin and the barrel to serve as an elevation mark. Arcs marked on the plate centered on the pin serve as lead indicators for moving targets.

Further, U.S. Pat. No. 7,328,531 to Dietz discloses method and apparatus for a device secured to a gun barrel of a firearm for helping to aim the gun at a moving target. The gun sight includes different-sized sight indicators including a first sight indicator located to be closer to the gunbarrel, and a second sight indicator, smaller than the first sight indicator and located to be further from the gunbarrel, both along a first direction that extends from the gunbarrel. In some embodiments use a plurality of different-sized of sight indicators along each of a plurality of directions for tracking moving targets approximately in those directions, for helping determine the amount of lead (the angle between the gunbarrel and the line to the target) used when shooting. Some embodiments use indicators, such as printed or embossed lines, icons, or tinted shapes, on a transparent substrate, while others use a wire-like structure formed with the indicators. Some embodiments use an anti-reflective coating.

Further, U.S. Pat. No. 6,321,479 to Sheehan discloses a sighting device having an aperture with a series of visual reference points framing the aperture that are used in concert with a vertical front sight to quickly acquire and precisely aim a firearm at a target. The visual reference points framing the aperture are readily discernable to a shooter, even though the reference points and the aperture may be visually out of focus as the shooter concentrates on the target. The visual reference points framing the aperture are in the form of edges, angles, and vertices that take advantage of the human eye's natural acuity for angular geometric shapes as the shooter visually coordinates the position of the present invention with the vertical front sight and a target. The unobstructed field of view provided by the aperture portion of the present invention combined with readily discernable geometrically shaped visual reference points framing the aperture assist the shooter in precisely aiming a firearm, or other projectile propulsion device, at a target. In addition, rapid and accurate adjustments, or refinements, in the shooter's aim at a target are readily effected with the present invention.

Still further, U.S. Pat. No. 5,067,244 to Montalvo discloses gun sight which is attached to the rear end of the gun barrel near the eye of the shooter including a semi-circular ring through which the shooter can observe a flying target. Two horizontal arms are attached to the sight for alignment parallel to the earth and with a target traveling through the air. Still further, U.S. Pat. No. 2,056,469 to King discloses a sight for a gun having multiple target sights.

However, the prior patents fail to describe a gun/rifle sight for tracking moving objects which is easy to use and efficient as is described in the present application. Further, these patents fail to provide a gun/rifle sight for tracking moving objects by easily selecting a preset lead time by altering the position of a sight.

SUMMARY OF THE INVENTION

A gun/rifle sight for tracking a moving object is provided. The gun sight may have a generally elongated frame secured at a distal end of a barrel of a gun in a perpendicular manner with respect to the barrel. In a first embodiment, the gun sight has plurality of pegs which independently and selectively move from a downward orientation to an upward orientation so as to allow a user to gauge the lead time for firing the gun at the moving object. In a second embodiment, a plurality of stationary pegs is secured in a staggered manner around a rotating cylindrical cover. When the cylindrical cover is rotated around the elongated stationary frame, only a single stationary peg may be moved to an upward orientation at a given time therein allowing the user to select the lead time for firing the gun at the moving object.

An advantage of the present gun/rifle sight for tracking a moving object is that the present gun/rifle sight for tracking a moving object is easy to install on the barrel of a gun or rifle.

Another advantage of the present gun sight for tracking a moving object is that the present gun sight for tracking a moving object allows a user to easily determine the lead time of an object being aimed at before firing.

Yet another advantage of the present gun sight for tracking a moving object is that the present gun sight for tracking a moving object may allow a user to quickly change the orientation of independent pegs on the sight so as to quickly alter the lead time for aiming at a moving object.

Still another advantage of the present gun sight for tracking a moving object is that the present gun sight may have a magnetic portion for more easily securing the sight to the barrel of the gun.

An advantage of the present gun sight for tracking a moving object is that the present gun sight for tracking a moving object has various sights all within the same plane so as to provide accurate shots.

And an advantage of the present gun sight for tracking a moving object is that the present gun sight for tracking a moving object may be used on guns/rifles having various sized barrels.

In yet another advantage of the present gun sight for tracking a moving object is that the present gun sight for tracking a moving object may have a first and second spring clip which allows the gun sight to easily and quickly be secured to the barrel of a gun.

For a more complete understanding of the above listed features and advantages of the present gun/rifle sight for tracking a moving object reference should be made to the detailed description and the drawings. Further, additional features and advantages of the invention are described in, and will be apparent from, the detailed description of the preferred embodiments.

BRIEF DESCRIPTION OF THE DRAWINGS

FIG. 2A illustrates a front view of one embodiment of a peg for the gun sight.

FIG. 2B illustrates a side view of the embodiment of the peg in FIG. 2A.

FIG. 3A illustrates a front view of one embodiment of a peg for the gun sight.

FIG. 3B illustrates a side view of the embodiment of the peg of FIG. 3A.

FIG. 4A illustrates a front view of one embodiment of the peg for the gun sight.

FIG. 4B illustrates a side view of the embodiment of the peg of FIG. 4A.

DETAILED DESCRIPTION OF THE PREFERRED EMBODIMENTS

A gun/rifle sight for tracking a moving object is provided. The gun sight may have a generally elongated frame secured at a distal end of a barrel of a gun in a perpendicular manner with respect to the barrel. In a first embodiment, the gun sight has plurality of pegs which independently and selectively move from a downward orientation to an upward orientation so as to allow a user to gauge the lead time for firing the gun at the moving object. In a second embodiment, a plurality of stationary pegs is secured in a staggered manner around a rotating cylindrical cover. When the cylindrical cover is rotated around the elongated stationary frame, only a single stationary peg may be moved to an upward orientation at a given time therein allowing the user to select the lead time for firing the gun at the moving object.

Figure 1:
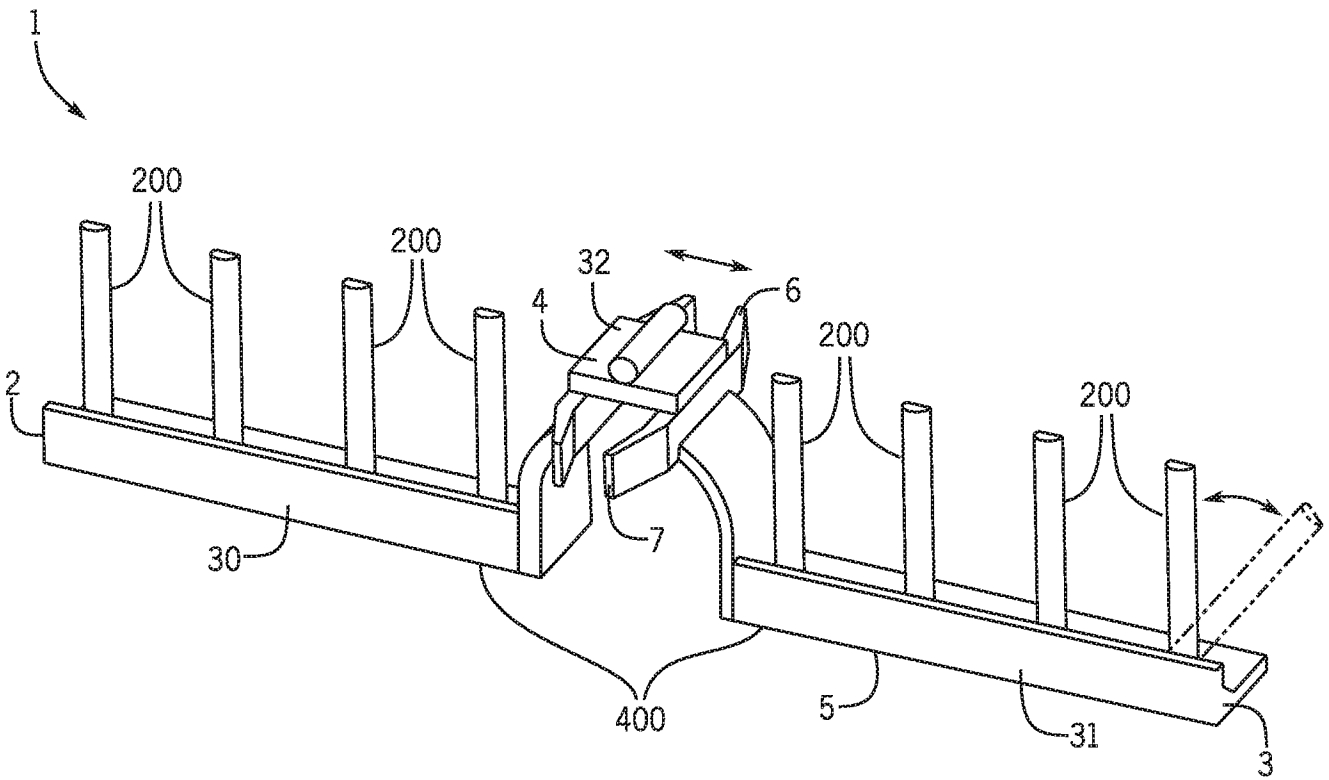
FIG. 1 illustrates a perspective view of a first embodiment of a gun sight for tracking a moving object.
Figure 13:
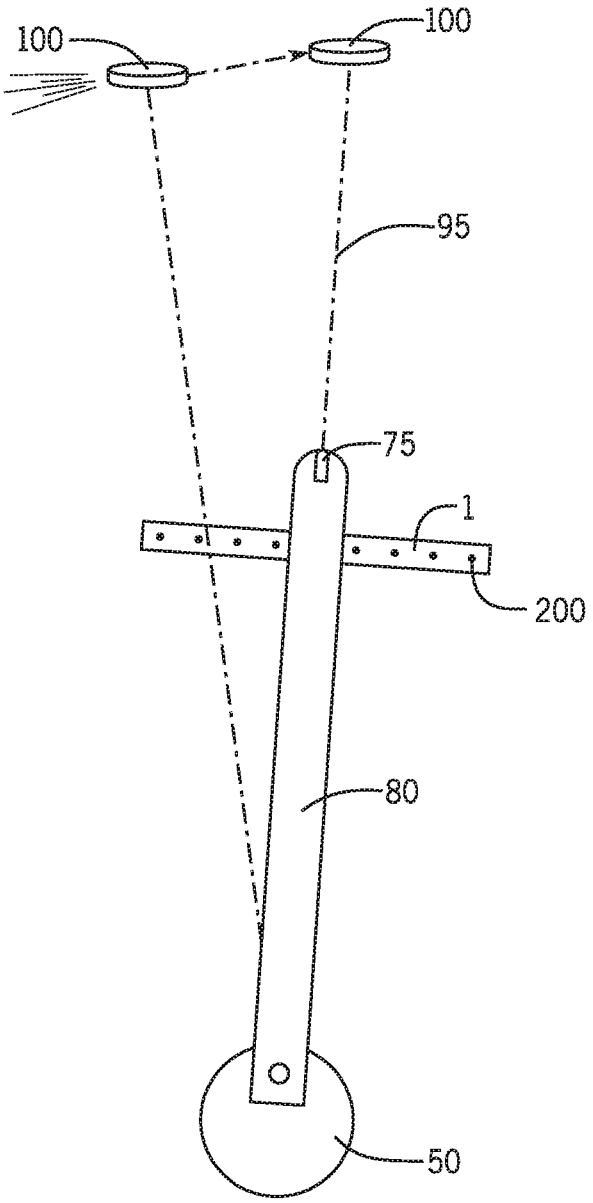
FIG. 13 illustrates an overhead view of the second embodiment of the device secured to the barrel of a gun/rifle wherein the object being shot at is illustrated.

Referring first to FIG. 1, in a first embodiment a gun/rifle sight 1 for tracking a moving object 100 (FIG. 13) is provided. The gun sight 1 may be generally made from a durable material, such as a durable plastic or metal. It should be understood that the word "gun" in the present application may also refer to a 'rifle' or any other firearm. The gun sight 1 may be generally elongated having a first end 2, a second end 3, a top 4, a bottom 5, a front 6 and a back 7. When installed on a gun 50 (FIG. 13), the gun sight 1 may be secured to the distal end 75 of a barrel 80 of the gun 50 in a generally perpendicular manner with respect to the barrel 80 of the gun 50. The first end 2 of the gun sight 1 may be located on a first arm 30 of the gun sight 1 and the second end 3 may be located on a second arm 31 wherein the first arm 30 and the second arm 31 are mirror images and separated by the main body 32 of the gun sight 1.

Figure 7:
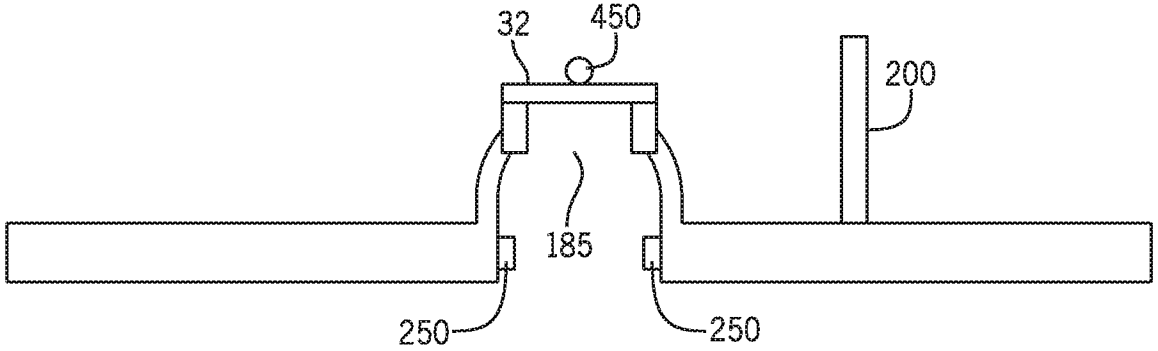
FIG. 7 illustrates a front view of the gun sight in an embodiment wherein only one peg is in the upward position (the functional position).

In the first embodiment (FIG. 1), the gun sight 1 may have a plurality of independently moving pegs 200 secured to the stationary main supporting frame member 400 (comprised of the first arm 30 and second arm 31). Although the figures generally illustrate a total of eight independently moving pegs 200, the device 1 may be made with a fewer or greater number of independently moving pegs 200. The independently moving pegs 200 may move (approximately ninety degrees) from a first orientation (where in the pegs 200 are generally parallel to the ground) to a second "upward" orientation (wherein the pegs 200 are generally vertical with respect to the ground). FIG. 1 illustrates seven pegs 200 in the second "upward" orientation and one peg 200 (the far right peg) in the process of being moved to the first orientation. In use, a user generally presets the independently moving pegs 200 so that only a single peg 200 is rotated upward to the second orientation while the remaining seven (in an eight peg 200 version) remain in the first of "down" orientation, as illustrated in FIG. 7. Thus, in use, the device 1 would look as illustrated in FIG. 7, not as is illustrated in FIG. 1. In an embodiment, the independently moving pegs 200 are independently colored and wherein their color corresponds to the distance from the peg 200 to the barrel 80 of the gun 50.

Depending on the location of which single peg 200 is rotated upward into the second orientation, the user may gauge the approximate distance (or lead time) for a moving object 100. In particular, if, for example, the object 100 being shot at by the shooter is far away from the shooter, the shooter may select, for example, one of the more distal pegs 200 (illustrated in FIG. 7) from the barrel 80 of the gun 50. If the object 100 being shot at by the shooter is closer to the shooter, the shooter may select, for example, a peg 200 closer to the barrel 80 of the gun 50 (or may use none of the pegs). In particular, because of standard parameters in skeet shooting (such as the distance away from the shooter the object 100 is launched, the angle of the launch and the speed of the launch), the peg 200 selected on the device 1 allows a user to accurately estimate the lead time the object 100 is away from the imaginary extended axis line 95 (FIG. 13) of the barrel 80 of the gun 50.

Figure 12:
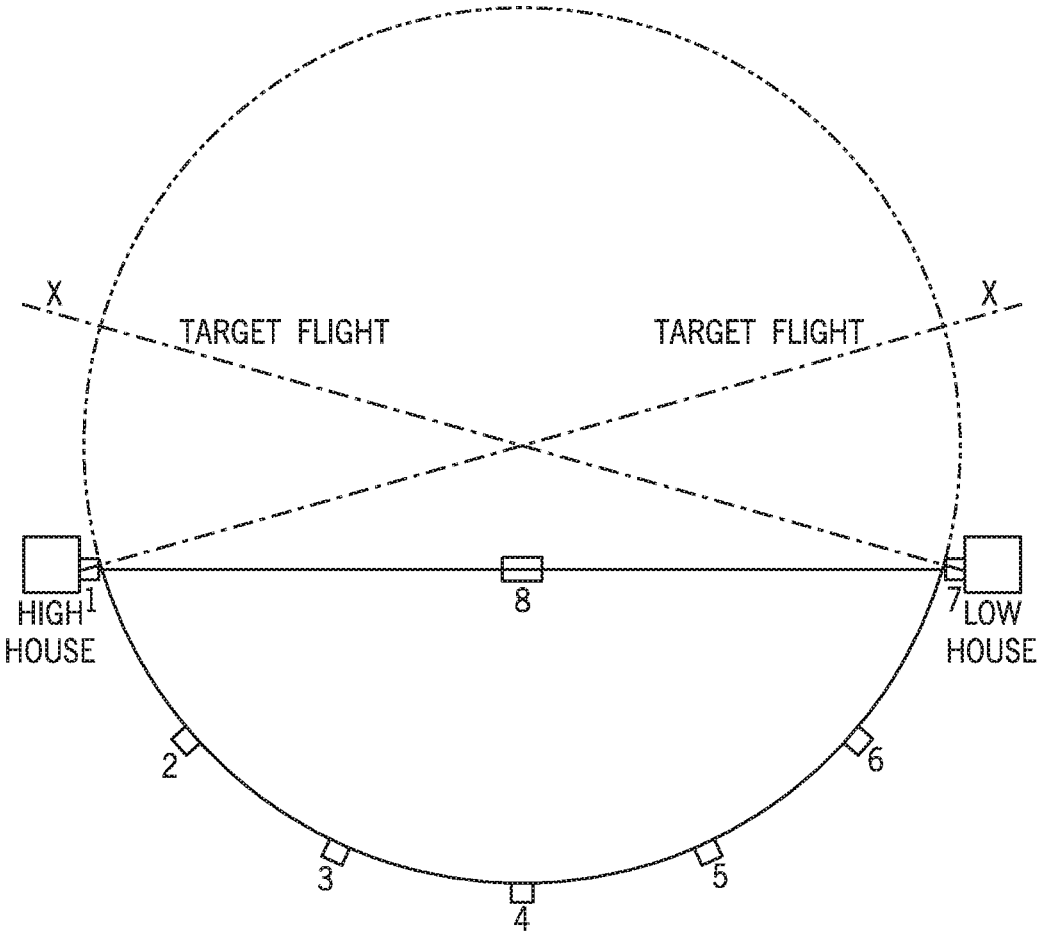
FIG. 12 illustrates a chart of the skeet field layout and the dimension of a standard skeet field.

The below chart illustrates the proper peg 200 selection based on the station the shooter is located at: (further, see FIG. 12).

The skeet lead has four peg or stations that represent lead indicators for an object 100 (skeet) moving at approximately 38-40 mph. When shooting a shotgun 50 at the moving object 100 that is moving approximately 38 mph from 63' (station 4) away, an approximate 4' lead is required, which is represented by the $4^{th}$ (or furthest peg) 200. Each peg 200 moving towards the barrel 80 represents a 1' reduction in lead to the corresponding station.

| | |
|---|---|
| Station 1 & 7 | $1^{st}$ peg nearest barrel |
| Station 2 & 6 | $2^{nd}$ peg nearest barrel |
| Station 3 & 5 | $3^{rd}$ peg nearest barrel |
| Station 4 | $4^{th}$ peg from barrel |

Figure 8:
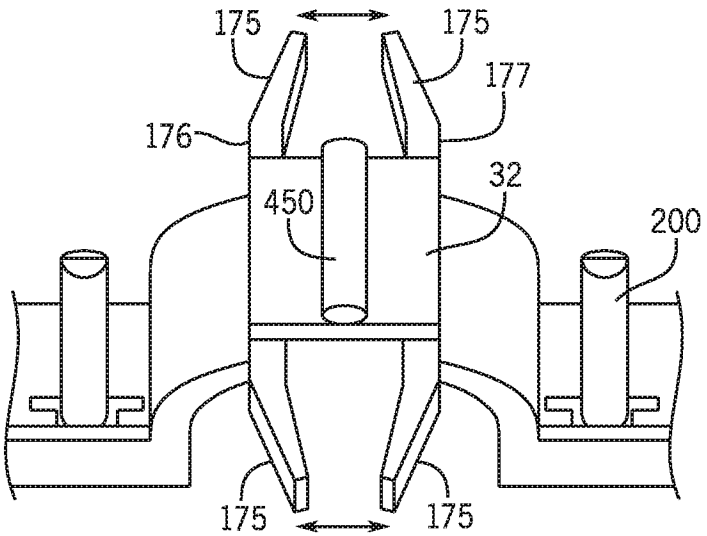
FIG. 8 illustrates a perspective view of the top of the middle section of the gun sight in one embodiment.

In an embodiment, both the front 6 and the back 7 of the gun sight 1 may each have a built in spring device 175 (FIG. 8). Each built in spring device 175 may have an elongated first prong 176 and an elongated second prong 177 wherein the first prong 176 and second prong 177 angle in toward each other and toward the main body 32 of the device 1. Memory tension forces the first spring 176 and second prong 177 toward each other (as illustrated in FIG. 8). When the device 1 is secured to the barrel 80 of a gun 50, the first prong 176 and second prong 177 are slightly bent outward so as to grasp the barrel 80 of the gun 50 and to hold the gun 50 by friction. Thus, at least a portion of the barrel 80 of the gun 50 passes through an arch 185 (FIG. 7) and rests under the main body 32 of the device 1. As a result of the spring tension of the spring device 175, the present device 1 may be used on various guns 50 having various barrel 80 diameters. Further, due to the spring tension, the device 1 may easily be added or removed from the barrel 80 of the gun 50. An alternative dead center site 450 for aiming may be located on the top of the main body 32 of the device 1 in one embodiment.

In an alternative embodiment, the gun sight 1 may have at least one magnet 250 (FIG. 7). The magnet 250 may be located on, for example, the main body 32 of the device 1. The magnet 250 may allow the gun sight 1 to more easily be secured to the barrel 80 of the gun 50. In particular, the magnet 250 may be used instead of, or in addition to the spring device 175.

Figure 9:
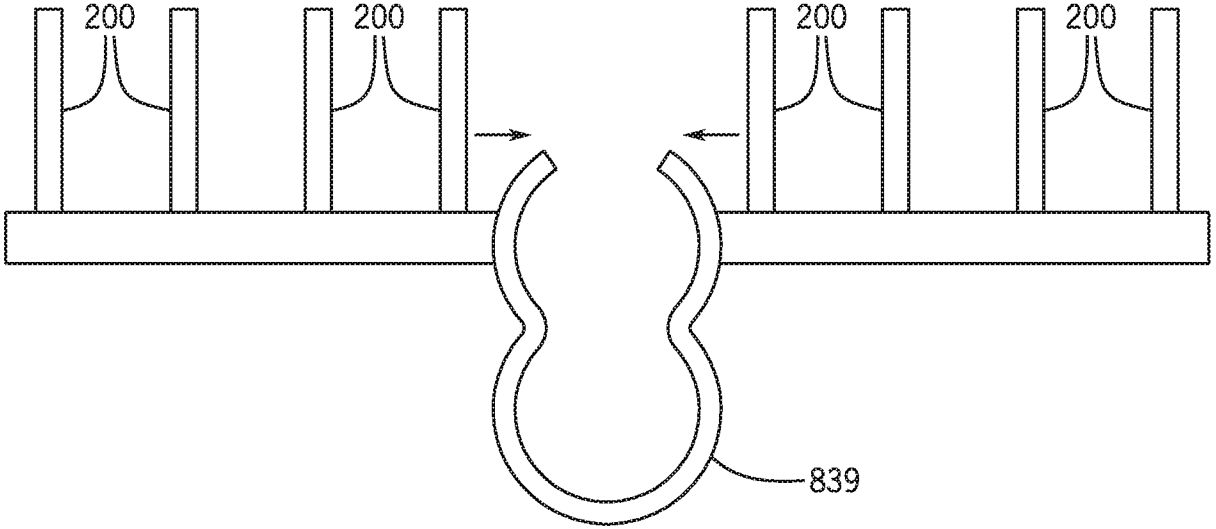
FIG. 9 illustrates a front view of a second embodiment of the gun sight wherein the gun sight is partially secured under the barrel of the gun.
Figure 10:
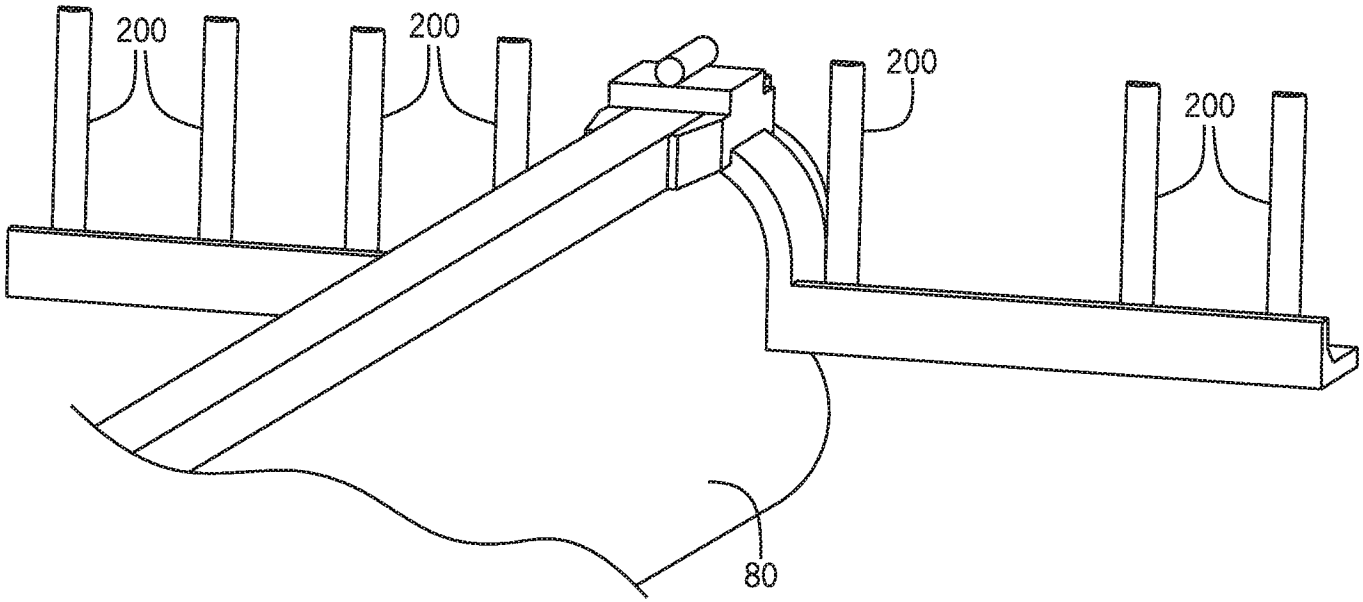
FIG. 10 illustrates a perspective view of the gun sight secured to the barrel of a gun and wherein one of the pegs is rotated downward.
Figure 11:
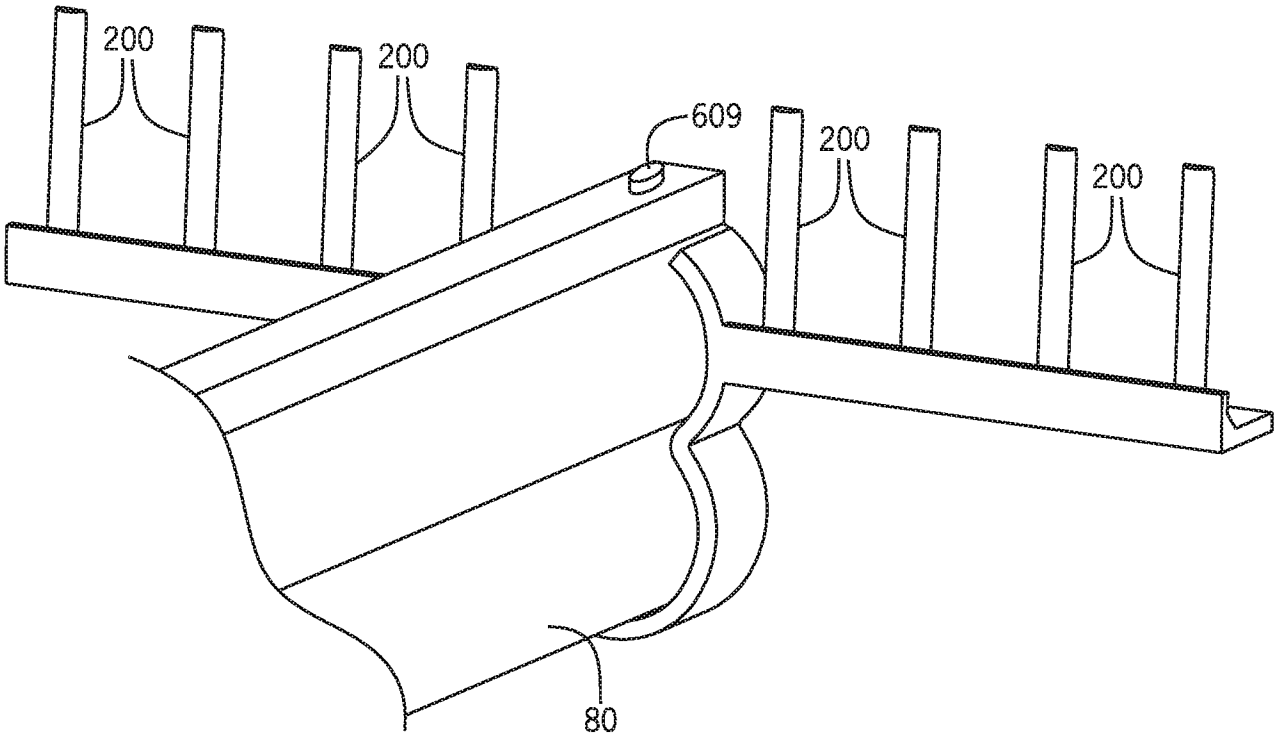
FIG. 11 illustrates a perspective view of a second embodiment of the gun sight partially secured under the barrel of a gun wherein all the pegs are in the upright position.

In an alternative second embodiment (FIGS. 9 and 11) the gun sight 1 may be secured partially under the barrel 80 of the gun 50. In particular, in this embodiment, a permanent sight 609 of the gun barrel 80 may still be used and may not interfere with the use of the present device 1. More specifically, in FIG. 1, the device 1 may be place over the barrel 80 of a gun 50 whereas in FIG. 11 the device 1 is placed under the barrel 80 of the gun so that the gun's permanent sight 609 may still be used and the main body 32 will not interfere with the gun's permanent sight 609. FIG. 9 illustrates a main securing unit 839 connecting the two arms of the device 1, wherein the main securing unit 839 is flexible and slightly bends to grasp and secure the barrel of the gun. The main securing unit 839 of FIG. 9 acts similar to the main body 32 of FIG. 1.

Figure 5:
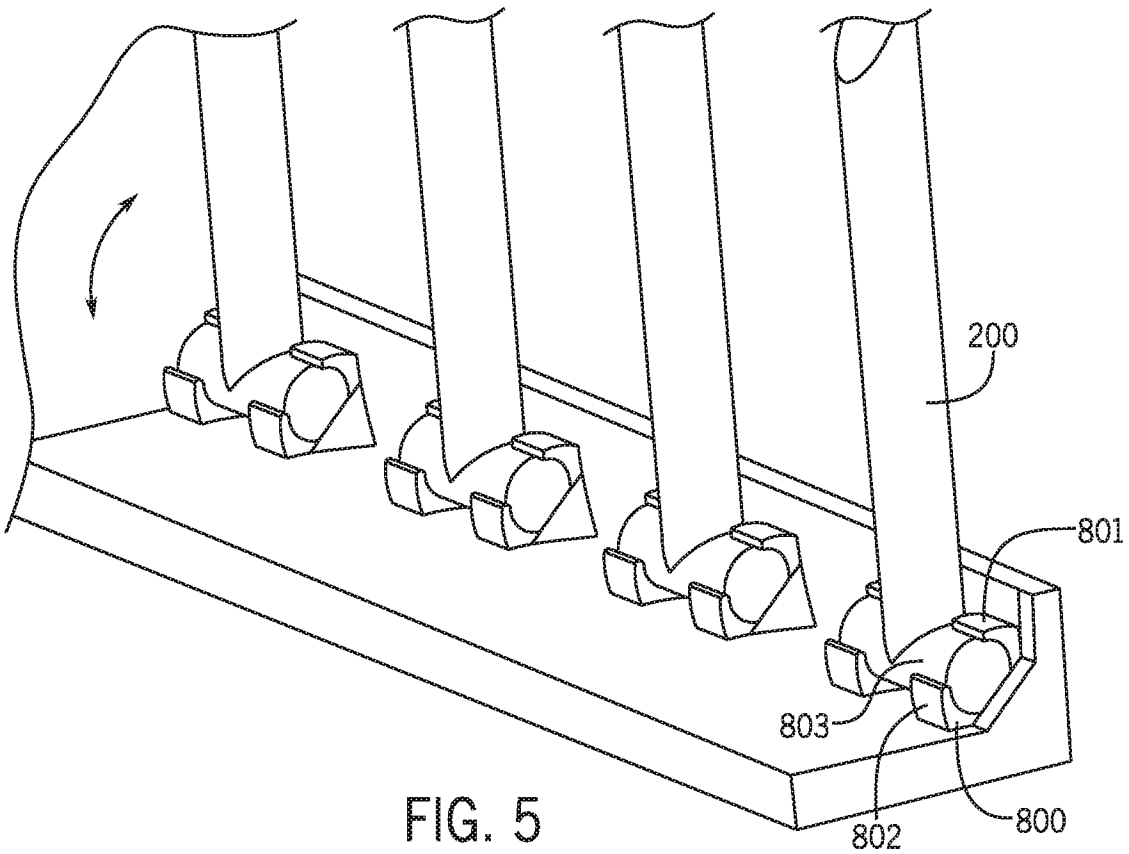
FIG. 5 illustrates a perspective close-up view of the pegs in an embodiment wherein the pegs are secured to the main gun sight.

Referring now to FIG. 5, in an embodiment, a plurality of locking mechanisms 800 may be located on the first arm 30 and second arm 31 of the device 1. The locking mechanisms 800 may comprise a first unit 801 and a second unit 802 which allows a rotating cylindrical base 803 of the pegs 200 to be temporarily secured in the securing mechanism 800. As a result, a user may select the various type of peg 200 (limited embodiments of which are illustrated in FIGS. 2A-4B) depending on the type of shooting the user is doing or based on personal preference and may interchange the pegs 200 upon will by snapping the pegs 200 into the locking mechanism 800. In an embodiment, a peg 200 may have a colored indicator section 265 (FIG. 4A) for additional aide wherein the colored indicator section 265 contrasts with the remaining color of that specific peg 200.

Figure 6:
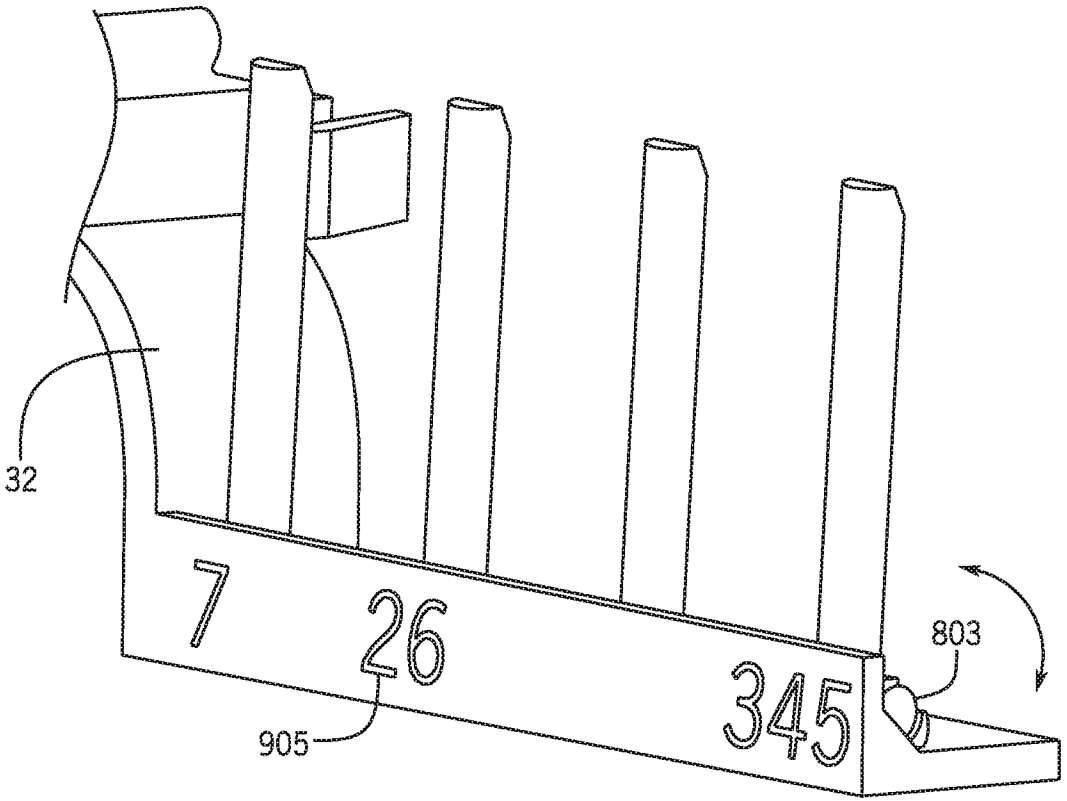
FIG. 6 illustrates a perspective view of the pegs of the gun sight wherein a distance indicator (indicia) is present on an arm of the gun sight.

In an embodiment, indicia 905 (FIG. 6) may be located on the first arm 30 and/or second arm 31. The indicia 905 may provide the user with timing and/or distance information with respect to the object 100 being aimed at by the device 1.

Figure 14:
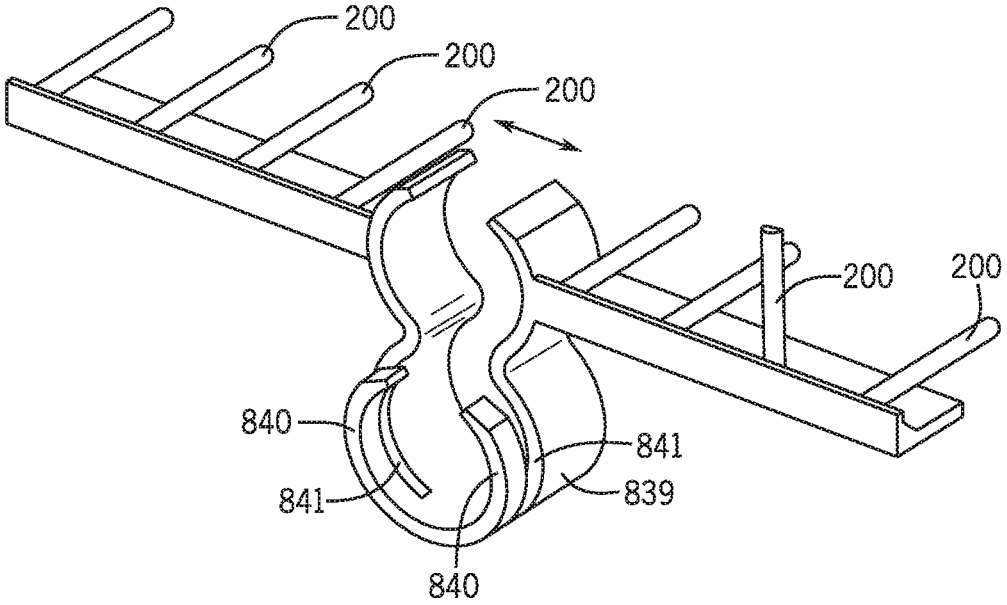
FIG. 14 illustrates a perspective view of an alternative embodiment of the device wherein the device has independently moving securing mechanisms connected to the main securing unit to better grasp the barrel of the gun/rifle.

Referring now to FIG. 14, in an alternative embodiment, the gun site 1 may have independently moving securing mechanisms 840. The independently moving securing mechanisms 840 may be separated from the main securing unit 839 by slits 841. The slits 841 may allow the independently securing mechanisms 840 to better grasp and secure the barrel 80 of the gun/rifle 50. In an embodiment, the independently moving securing mechanisms 840 may have a diameter which is slightly less than a diameter of the main securing unit 839 so as to better grasp the barrel 80 of the gun 50.

Figure 15:
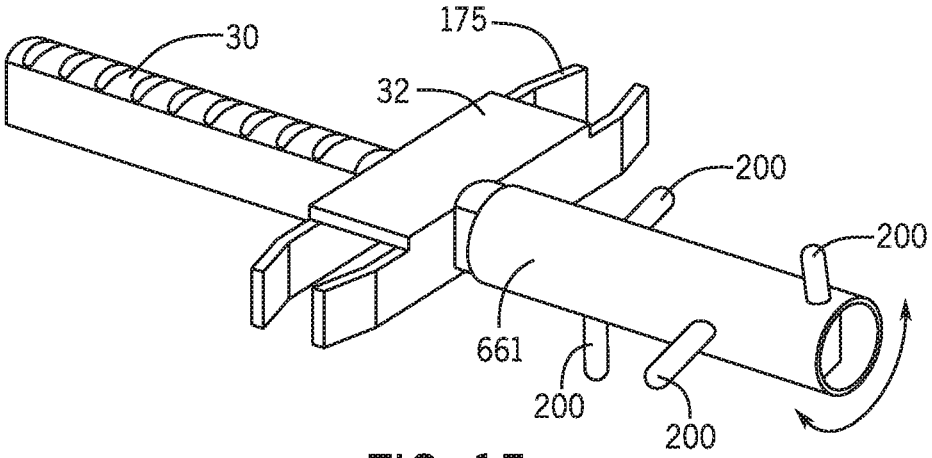
FIG. 15 illustrates an alternative embodiment wherein a rotating cylindrical tube having extending pegs is utilized as opposed to pivoting pegs.
Figure 16:
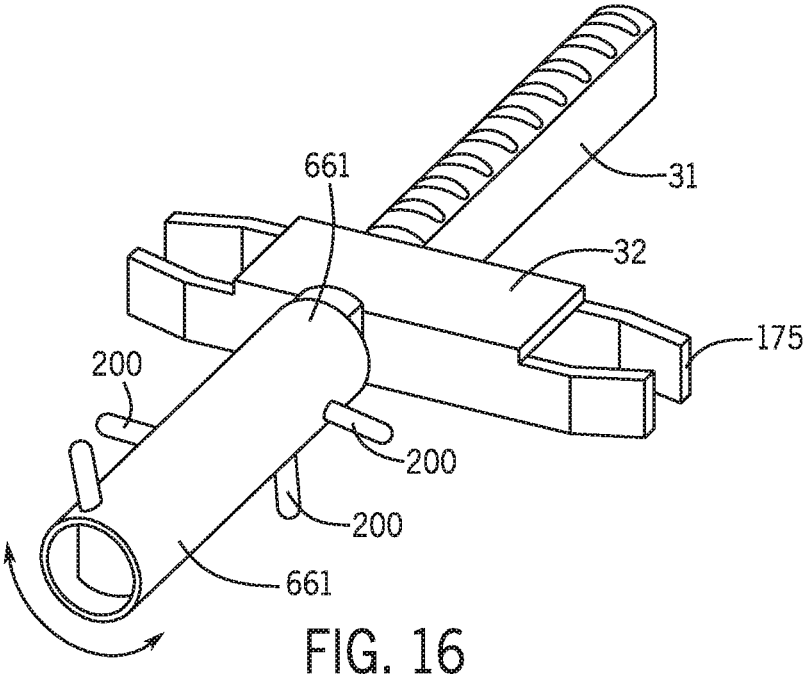
FIG. 16 illustrates the alternative embodiment of FIG. 15 utilized on the opposing side of the device.
Figure 17:
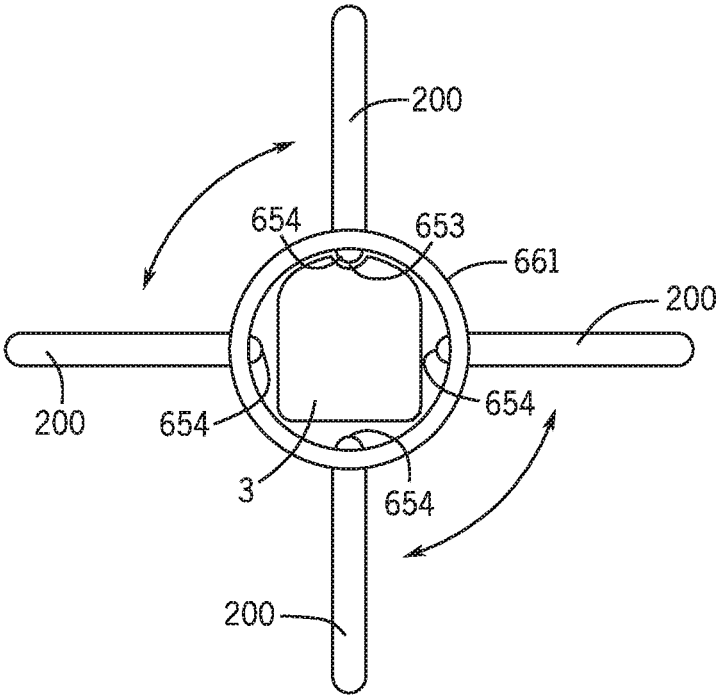
FIG. 17 a side view of the alternative embodiment of FIG. 16.

Referring now to FIGS. 15-17, in yet another alternative embodiment, the device 1 may utilize a rotating cylindrical tube 661 as opposed to the pivoting peg 200 embodiment as is shown in FIG. 1. The rotating cylindrical tube 661 may have, for example, four permanently extending stationary pegs 200 wherein the pegs 200 are staggered and, in one embodiment, approximately ninety degrees apart and at approximately the same distance away from each other as the pegs 200 in FIG. 1. More specifically, no two pegs 200 on the rotating cylindrical tube 661 are the same distance away from the imaginary extended axis line 95. The rotating cylindrical tube 661 may rotate three hundred and sixty degrees around the first arm 30 and the second arm 31.

In this alternative embodiment, the user rotates the rotating cylindrical tube 661 around the first arm 30 or the second arm 31 of the device 1. A protrusion 654 located inside the rotating cylindrical tube 661 (directly opposite each of the pegs 200) may temporarily lock into an indentation 653 located on the top of the first rotating arm 30 and second rotating arm 31 by friction. More specifically, a user may manually turn the rotating cylindrical tube 661 until the desired peg 200 is located in the upward position. A quarter turn may switch which peg 200 is located in the upward position. At any given time, only one peg 200 may face upward. As a result, a user may turn the rotating cylindrical tube 661 to select the desired peg 200 location away from the imaginary extended axis line 95 so as to best aim at the target object 100.

To use the device 1 in practice, the shooter may follow the following steps:

Use of Radar Gun for Setting Skeet Targets

1. Check high house-set at 46.0 to 46.9 miles per hour. Stand on station 1 and aim gun at the top of the hoop. DO NOT TOUCH THE TRIGGER. Hold gun steady and throw a target through DEAD-CENTER (+ or −6 inches) of hoop. The top speed will be measured approx. way to the hoop. Set spring tension within above speeds. A good machine with good targets will throw 4 consecutive targets through a 12" hoop under "NO WIND" conditions. The targets will strike level grounds 58-59 yards from the high house. As shooting progresses the transmissions warm the oil and the targets fall at 61-62 yards.

2. Check low house-set at 48.0-48.9 miles per hour. Aim gun at the top of the hoop. Targets will fall as above.

Setting Up the Radar Gun

1. Turn on "power"
2. Push "self test" or use calibration fork (included)
3. Push "set up" mode. Use "A-25" recommended for skeet. Speeds are recorded in 1/10 miles per hour and the gun disregards all movements slower than 25 MPH
4. Push "x-mit" button-turns on transmitter
5. Push "peak-hold" button-display fastest speed only The gun is now ready for use NOTES: Targets slow down approximately 8 miles per hour from the arm to the hoop. Speeds will self-clear from the screen in a couple of seconds. Pushing "x-mit" to hold will lock-in the top speed with the use of the trigger. Radar guns often pick up targets from adjoining fields. Altitude has negligible affect on distance once the springs are set for above speeds. Tests show that targets set manually on multiple fields by real experts will vary 3-4 MPH. Targets set properly will cross approx 1 foot to the right of center (hypotenuse). No further adjustments will be required on spring tension. Speeds will remain constant for weeks. Selecting a radar gun is important as a 15 milliwatt microwave system is far superior to a 5 milliwatt. We have used 4 different guns—1 bad—2 fair—1 excellent.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

I claim:

1. A gun/rifle sight for tracking a moving object comprising:

a housing having a first side arm having a first end, a second side arm having a second end wherein the first side arm and the second side arm are separated by a main body;

a first cylindrical tube substantially covering the first side arm and a second cylindrical tube substantially covering the second side arm wherein the first cylindrical tube rotates three hundred and sixty degrees around the first side arm and wherein the second cylindrical tube rotates three hundred and sixty degrees around the second side arm;

a plurality of stationary pegs located on the first cylindrical tube and a plurality of stationary pegs located on the second cylindrical tube wherein the plurality of stationary pegs of the first cylindrical tube and the second cylindrical tube are staggered;

wherein the main body of the housing is partially secured around a barrel of a gun or rifle; and a securing mechanism located on the main body wherein the securing mechanism secures the main body of the housing to the barrel of the gun or rifle.

2. The gun/rifle sight for tracking a moving object of claim 1, further comprising:

a generally hollow interior of the first cylindrical tube and a generally hollow interior of the second cylindrical tube.

3. The gun/rifle sight for tracking a moving object of claim 2, further comprising:

a plurality of protrusions located within the generally hollow interior of the first cylindrical tube and the second cylindrical tube wherein the plurality of protrusions are located directly beneath each of the plurality of stationary pegs.

4. The gun/rifle sight for tracking a moving object of claim 3, further comprising:

an indentation on a top of the first side arm and an indentation on a top of the second side arm wherein the indentation of the top of the first side arm and the second side arm temporarily receives and secures one of the plurality of protrusions.

5. A gun/rifle sight for tracking a moving object, comprising:

a housing having a first side arm having a first end, a second side arm having a second end wherein the first side arm and the second side arm are separated by a main body;

a plurality of independently movable pegs wherein the independently movable pegs move from a first position to a second position and wherein the independently movable pegs are located on both the first side arm and the second side arm;

wherein the main body of the housing is partially secured around a barrel of a gun or rifle;

a securing mechanism located on the main body wherein the securing mechanism secures the housing to the barrel of the gun; and wherein the independently moving pegs move ninety degrees from the first position to the second position wherein the independently moving pegs are in a generally horizontal orientation in the first position and a generally vertical orientation in the second position with respect to the ground.

6. A gun/rifle sight for tracking a moving object, comprising:

a housing having a first side arm having a first end, a second side arm having a second end wherein the first side arm and the second side arm are separated by a main body;

a plurality of independently movable pegs wherein the independently movable pegs move from a first position to a second position and wherein the independently movable pegs are located on both the first side arm and the second side arm;

wherein the main body of the housing is partially secured around a barrel of a gun or rifle;

a securing mechanism located on the main body wherein the securing mechanism secures the housing to the barrel of the gun; and a front of the first side arm and a front of the second side arm wherein the front of the first side arm and the front of the second side arm have indicia and wherein the indicia relates to the proper independently moving peg to be selected by a user in utilizing the gun/rifle sight.

7. The gun/rifle sight for tracking a moving object of claim 6 wherein the first side arm and the second side arm are mirror images of each other.

8. The gun/rifle sight for tracking a moving object of claim 6 further comprising:

a top of the main body wherein the top of the main body has an aiming sight.

9. The gun/rifle sight for tracking a moving object of claim 6 further comprising:

a plurality of locking mechanisms wherein the plurality of locking mechanism each receive one of the plurality of independently moving pegs and wherein the plurality of locking mechanisms are capable of temporarily securing one of the independently moving pegs and capable of allowing an alternative independently moving peg to replace an existing independently moving peg.

10. The gun/rifle sight for tracking a moving object of claim 6 wherein the main body of the housing is partially secured above a top of the barrel of the gun/rifle.

11. The gun/rifle sight for tracking a moving object of claim 6 wherein the main body of the housing is partially secured below a bottom of the barrel of the gun/rifle.

12. The gun/rifle sight for tracking a moving object of claim 6 further comprising:

an independently moving grasping mechanism secured to the main body of the housing wherein the independently moving grasping mechanism has a first arm and a second arm which grasp a barrel of the gun/rifle.

13. A gun/rifle sight for tracking a moving object, comprising:

a housing having a first side arm having a first end, a second side arm having a second end wherein the first side arm and the second side arm are separated by a main body;

a plurality of independently movable pegs wherein the independently movable pegs move from a first position to a second position and wherein the independently movable pegs are located on both the first side arm and the second side arm;

wherein the main body of the housing is partially secured around a barrel of a gun or rife;

a securing mechanism located on the main body wherein the securing mechanism secures the housing to the barrel of the gun; and a magnet secured to the main body of the housing wherein the magnet magnetically secures the gun/rifle sight to a barrel of the gun/rifle.

14. The gun/rifle sight for tracking a moving object of claim 13 wherein the first side arm and the second side arm are mirror images of each other.

15. The gun/rifle sight for tracking a moving object of claim 13 further comprising:

a top of the main body wherein the top of the main body has an aiming sight.

16. The gun/rifle sight for tracking a moving object of claim 13 further comprising:

a plurality of locking mechanisms wherein the plurality of locking mechanism each receive one of the plurality of independently moving pegs and wherein the plurality of locking mechanisms are capable of temporarily securing one of the independently moving pegs and capable of allowing an alternative independently moving peg to replace an existing independently moving peg.

17. The gun/rifle sight for tracking a moving object of claim 13 wherein the main body of the housing is partially secured above a top of the barrel of the gun/rifle.

18. The gun/rifle sight for tracking a moving object of claim 13 wherein the main body of the housing is partially secured below a bottom of the barrel of the gun/rifle.

19. The gun/rifle sight for tracking a moving object of claim 13 further comprising:

an independently moving grasping mechanism secured to the main body of the housing wherein the independently moving grasping mechanism has a first arm and a second arm which grasp a barrel of the gun/rifle.

20. The gun/rifle sight for tracking a moving object of claim 13 wherein the independently moving pegs move ninety degrees from the first position to the second position wherein the independently moving pegs are in a generally horizontal orientation in the first position and a generally vertical orientation in the second position with respect to the ground.

* * * * *